United States Patent [19]

Talent et al.

[11] 4,157,598

[45] Jun. 12, 1979

[54] PAINT BRUSH HAVING DETACHABLE EXTENSION ROD

[76] Inventors: Charles H. Talent; Carol S. Talent, both of 1204½ Freeman Ave., Long Beach, Calif. 90804

[21] Appl. No.: 901,013

[22] Filed: Apr. 27, 1978

[51] Int. Cl.[2] ..... A46B 7/02; B25G 1/04; B25G 3/30

[52] U.S. Cl. ..... 15/145; 15/143 B; 15/146; 403/296

[58] Field of Search ..... 15/143 B, 144 B, 145, 15/146, 176; 401/286–289; 403/4, 296–299; D4/38

[56] References Cited

U.S. PATENT DOCUMENTS

| | | | |
|---|---|---|---|
| D. 204,449 | 4/1966 | Zavodsky | D4/38 |
| 115,040 | 5/1871 | Dunaway | 403/299 X |
| 927,872 | 7/1909 | Price | 401/287 |
| 1,065,610 | 9/1913 | Hooker | 401/289 X |
| 2,172,479 | 9/1939 | McMillen | 15/146 X |
| 2,705,336 | 4/1955 | Wilson | 15/145 |
| 3,668,731 | 6/1972 | McBride | 15/146 |
| 3,994,037 | 11/1976 | Sims | 15/146 |

FOREIGN PATENT DOCUMENTS

| | | | |
|---|---|---|---|
| 579564 | 6/1933 | Fed. Rep. of Germany | 403/299 |
| 741952 | 11/1943 | Fed. Rep. of Germany | 15/145 |
| 41432 | 10/1932 | France (Addition to 699,690) | 401/290 |
| 273355 | 2/1951 | Switzerland | 403/299 |
| 6319 of | 1887 | United Kingdom | 15/145 |

*Primary Examiner*—Daniel Blum

*Attorney, Agent, or Firm*—Fulwider, Patton, Rieber, Lee & Utecht

[57] ABSTRACT

A paint brush, having a handle extending from a stock into which bristles are fastened is provided with and adapter to which an extension rod or pole may be attached. The adapter is connected to the stock adjacent to the termination of the handle in the stock, and at an angle to the handle. The adapter, handle and stock, are in coplanar arrangement. The adapter is constructed to releasably receive an extension rod, preferrably in threaded engagement. With the extension rod, the improved paint brush may be used to paint floor and ceiling mouldings and the junction between floors and ceilings without the aid of a ladder.

7 Claims, 4 Drawing Figures

PAINT BRUSH HAVING DETACHABLE EXTENSION ROD

BACKGROUND OF THE INVENTION

1. Field of the Invention

The present invention relates to paint brushes and devices for painting locations which are otherwise accessible only with difficulty.

2. Description of the Prior Art

In years past, various devices have been devised to aid in reducing the time and difficulty required to paint both the interiors and exteriors of buildings. Historically, buildings were painted using conventional brushes having a handle which could be grasped, a flattened stock connected to the handle, and bristles fastened to the opposite end of the stock. Painters would then use ladders, scaffolds and other types of supports so that they could move to elevated positions where they could paint the upper portions of walls, ceilings, junctions of walls and ceilings, and ceiling moldings in interior structures as well as eaves, overhangs, gutters, and facia on exterior building surfaces. This process is quite laborious, time consuming and fatiguing, however.

One development which added significantly to the speed with which painting could progress was the paint roller. This device includes an absorbent cylindrical roll rotatively mounted on a wire frame which terminates in a handle. Instead of brushing paint on by using the absorbency of paint brush bristles, paint is instead rolled on so that the paint is carried to the surface of application in the absorbent structure of the roller cylinder. However, paint rollers are inferior to brushes in at least one very significant aspect. While well suited for painting expansive flat surfaces, rollers are unable to cover the junctions between walls and ceilings or to conform to the surfaces of molding or other trim. Thus, it has always been necessary to complete a painting job undertaken with a paint roller by reverting to the prior system of mounting a ladder or other support and completing elevated trim, wall and ceiling junctions using a conventional paint brush.

One further device which has been used with some success to paint wall and ceiling junctions is an absorbent pad mounted upon a flat rigid backing and having small rollers along one edge thereof. This pad can be moved by hand along a linear junction of two plane surfaces, such as wall and ceiling, to paint the intersection thereof on one of the two surfaces at a time. Painting in this manner proceeds fairly rapidly along an area easily accessible by hand. As with a conventional paint brush, however, the length of the stroke is largely limited by the reach of a human arm. An individual using such a paint pad must repeatedly mount and dismount a ladder, repositioning the ladder each time in order to traverse the room perimeter to complete the painting job. Furthermore, because of their flat configuration, paint pads are unable to cover contoured molding, window casings, door casings and other trim. Also, because of the constant physical movement required, use of such a paint pad is just as fatiguing as is use of a conventional paint brush.

One further system which has been employed to paint structures is a paint sprayer. A paint sprayer uses compressed air to atomize liquid paint into a fine mist which is propelled by the compressed air through ambient air onto a surface to be painted. Painting in this manner proceeds quite rapidly and coverage is complete at window frames, wall-ceiling junctions, across molding, door and window casings, and other trim, and at other inaccessible or irregular surfaces to be painted. However, the spray painting compressor, compression tank and atomizing mixer are quite expensive and require considerable storage space. Furthermore, utilization of a paint sprayer applies paint to surfaces with very little control over application of the paint. As a consequence, paint is frequently misdirected in its application or drifts in the air and falls upon stained beams, woodwork, windows, counters, and virtually any other object or exposed structure within a room. The removal of excess paint from surfaces to which paint is erroneously applied, is at the very best extremely tedious and time consuming, and in many instances is totally impractical. For example, paint cannot really be removed from stained wooden surfaces without permanently altering the texture of those surfaces. In addition, spray painting represents a health hazard to the painter and to other individuals in the vicinity. Although the odor of paint exists in all methods of paint application the utilization of a paint sprayer generates a fine mist of paint which hangs in the air. When taken into the lungs of individuals in the vicinity as they breath, this paint represents a a significant irritant and reduces the length of time during which an individual can continuously stay in such an environment and paint.

The present invention provides a means by which locations which are otherwise accessible only with great difficulty can be painted without the use of ladders, scaffolds, or other supports. Because the basic structure of a paint brush has heretofore remained unaltered for virtually hundreds of years, this structure has always been considered a constraint in the utilization of brushes. For example, a conventional brush is shown mounted upon an elongated handle in U.S. Pat. No. 3,197,795. However, such an arrangement is not easily adjustable, as the brush attachment utilizes metal screws and wing nuts which are difficult to engage and disengage and which are easily misplaced when the brush is not attached to the pole or rendered inoperative when covered with paint. Moreover, the device disclosed in the aforesaid patent contemplates the mounting of a brush at right angles to an extension pole. Such a brush orientation makes painting ceiling junctions and elevated molding or trim extremely difficult, since the pole must be held vertically upright while manipulating the brush. This is extremely difficult to do and frequently results in painting mistakes. Moreover, this device, like other prior art systems, falls victim to the very fundamental mistake of failing to alter the construction of the brush itself.

SUMMARY OF THE INVENTION

The present invention, contemplates the use of a paint brush of modified construction. The paint brush of the present invention has an axial handle extending from a stock of oblong cross-section and having bristles at the opposing end, but modified in one very significant respect. At the location where the axial handle joins the stock, a well or bore is defined in the stock angling in toward the line of the axial handle. In the well, an adapter is securely fastened to allow an extension rod or pole to be releasably inserted and fastened. The adapter is preferably formed of stacked cylindrical cross-sectional portions of different diameters. At a section of reduced diameter the adapter resides in the well in the stock and at a section of increased diameter it protrudes external to the stock. Preferably, the adapter has a central tapped bore to receive the coarse threads defined in the end of an extension rod or pole. Such extension rods or poles are typically sold as broom handles, mop handles, and as extenders for use with paint rollers. However, because there has in the past been practically no departure from the historical paint brush construction, such poles have not previously been usable with paint brushes.

A significant feature of the improved paint brush of the invention is the angle of alignment of the adapter with the axial handle. Preferably, this angle is between about 30° and about 60°. While the exact preferable angular orientation may vary somewhat depending upon the physical stature of the person painting and the ceiling heights of the room to be painted, an orientation of the adapter relative to the axial handle of about 45°, allows the improved paint brush to be used in most applications. By mounting the extension rod at an angle relative to the axial handle of the paint brush, a person can easily manipulate the brush while standing on the floor to paint wall-ceiling intersections, ceiling trim, door and window casings, and and other types of elevated trim. Since the need for a ladder is obviated, the painter can rapidly proceed with painting without having to mount and dismount a ladder or readjust the position of the ladder. Moreover, by dispensing with the requirement for a ladder, congestion in a room being painted is alleviated. Furthermore, utilization of the improved paint brush of the invention allows ceiling trim and wall-ceiling intersections in stairwells to be painted much more easily than using conventional devices. These areas to date have been very difficult to paint because ladders cannot be safely positioned on stairs.

A further advantage of the invention is the ease with which painting can proceed and the less stringent physical demands required of the painter. By avoiding repeated mounting and dismounting of a ladder and the requirement for repeatedly maneuvering a ladder into position, and by avoiding excessive reaching by the painter, use of the improved paint brush is much less physically taxing on the painter. Work proceeds much more rapidly because the painter does not tire nearly as easily. This advantage is achieved not only in painting elevated areas, such as wall-ceiling intersections, but also in painting baseboards because bending and stooping or kneeling is avoided. It should be noted in this regard, that the angular disposition of the adapter relative to the axial paint brush handle is suitable both for painting elevated locations, and for painting baseboards and wall-floor intersections as well. The mounting angle is approximately the same in either situation, so that a single improved paint brush can be used for both purposes.

Another very significant object of the invention is to reduce safety hazards in painting. By eliminating the requirement for ladders, the improved invention reduces dramatically the largest single source of injury for painters. Not only are falls from elevated heights reduced, but in addition, falls from stumbling over ladders are also removed. By the same token, paint spills are likewise reduced, since such spills frequently occur when a can or tray of paint is jostled and falls from the shelf of a step ladder in conventional painting practice. This safety advantage is achieved without any offsetting hazard, such as saturation of the surrounding ambient area with a paint mist that occurs in paint spraying.

The improved paint brush of the invention may be described with greater particularity and clarity by reference to the accompanying drawings.

DESCRIPTION OF THE EMBODIMENT

Figure 1:
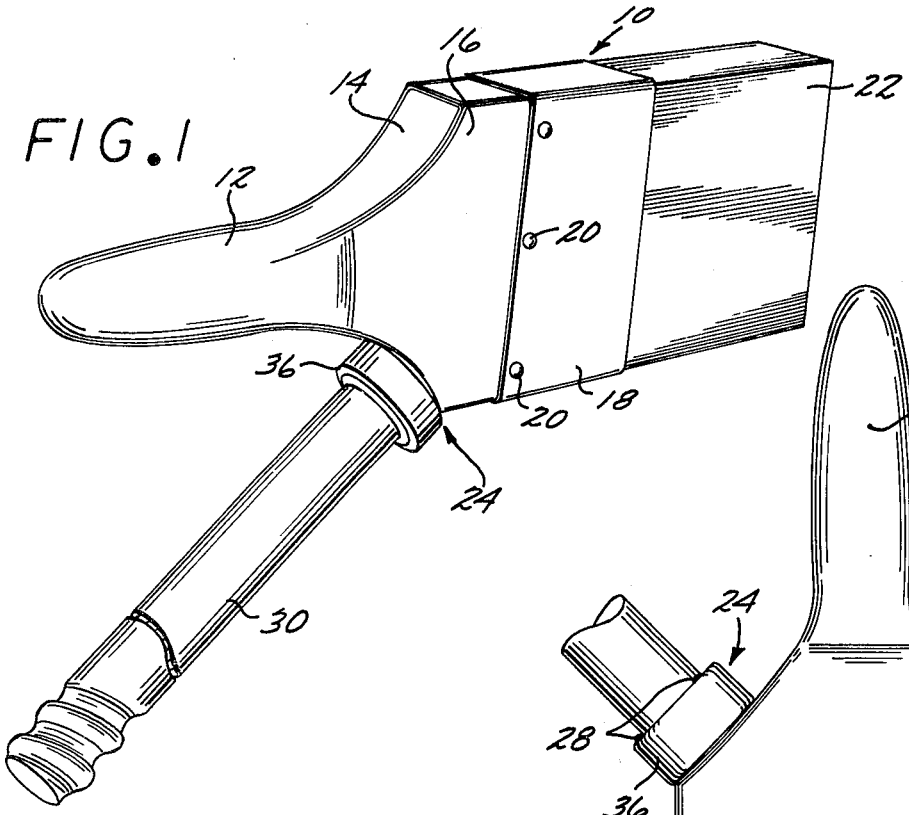
FIG. 1 is a perspective view of a paint brush according to the invention is the position in which it may be utilized.

FIG. 1 illustrates a paint brush 10 in which a handle or grip 12 extends axially outward from a transverse end 14 of a stock 16 of oblong cross-section. A reinforcing metal band 18 encircles the stock 16 and is attached thereto by screws or rivets, indicated at 20, to secure a multiplicity of bristles thereto. The bristles are indicated collectively at 22 in FIGS. 1 and 2.

Figure 2:
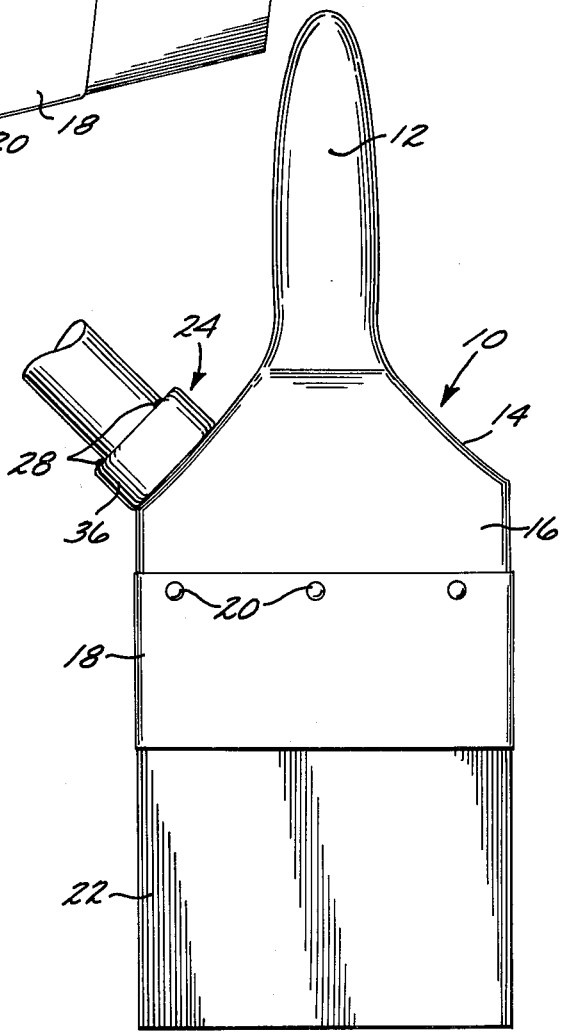
FIG. 2 is a side elevation view of the improved paint brush of the invention.
Figure 3:
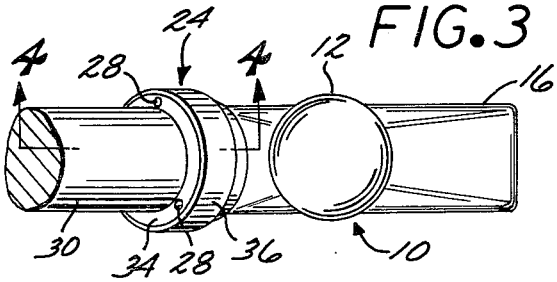
FIG. 3 is a top plan view of the paint brush of FIG. 2.

The paint brush 10 is equipped with a short, plug-like adapter 24, connected to the stock 16 at the end 14 and mounted at an angle relative to the axial handle 12. With reference to FIGS. 2 and 3, it can be seen that the handle 12, the stock 16 and the adapter 24, are all arranged in generally coplanar relationship.

Figure 4:
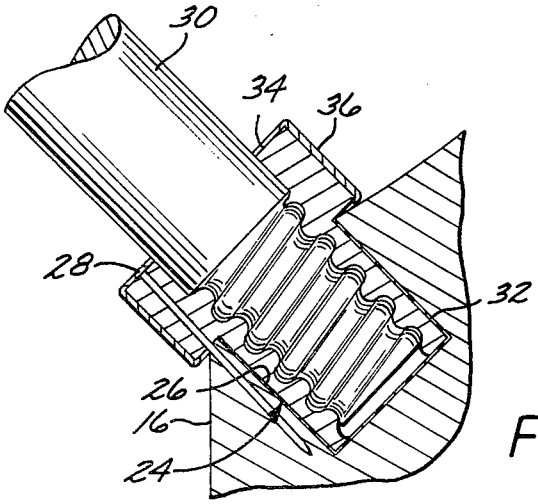
FIG. 4 is a cross-sectional detail of the adapter of the improved paint brush taken along the lines 4—4 of FIG. 3.

With the exception of the adapter 24, the paint brush 10 is otherwise very similar to conventional paint brushes which are commercially available. However, and as depicted in FIG. 4, a well 26 is defined in the stock 16 entering at the end 14 thereof and angling in toward the paint brush handle 12. The adapter 24 is press-fitted into the well 26 and is secured in immobile fashion therein by the forces of friction. It may be desirable to further secure the adapter 24 by the use of a locking mechanism, such as a set screw or pin 28, which passes through the adapter 24 parallel to the direction of orientation of the adapter 24 and into the structure of the stock 16. This prevents the adapter 24 from twisting within or being withdrawn from the stock 16 during disengagement of an extension rod 30, which may be releasably connected thereto.

Preferably the adapter 24 includes a section of reduced diameter, as at 32, which is largely surrounded by the structure of the stock 16, as depicted in detail in FIG. 4. Protruding from the stock 16 and located external thereto is a section of the adapter 24 indicated at 34, which is of increased expanded diameter relative to the section 32. Both the section 32 and the section 34 of the adapter 24 are of cylindrical cross-section.

One significant advantage of construction in this fashion is that a well of narrower diameter may be utilized in the stock 16. This is advantageous since it is desirable to preserve as much material of the stock 16 on either side of the well 26 as possible. A well 26 of inordinantly large diameter will result in a premature breaking down of the walls of the stock 16, due to the lateral forces which are exerted thereon by manipulation of the brush 10 using the extension rod 30. On the other hand, an outer or protruding section 34 is required to accommodate a central bore which is tapped to a diameter sufficiently large to receive a conventional extension rod.

Such extension rods are typically formed with a pitch diameter of approximately eleven-sixteenths (11/16) inches and with a thread pitch of three-sixteenths (3/16) inches. By constructing the adapter 24 with the section 34 of expanded outer diameter, the section 34 is provided with additional structural material to provide radial reinforcement and to prevent the threads of the extension rod 30 from working laterally within the tapped bore of the adapter 24. Still further reinforcement can be provided by surrounding the section 34 with an encircling metal band 36, as indicated in the drawings.

The extension rod 30 may be readily engaged and disengaged from the adapter 24. Conventional right hand threads are depicted in FIG. 4, so that clockwise rotation of the extension rod 30 in FIGS. 1 and 3 will drive the threads of the rod 30 deeper into the tapped central bore of the adapter 24, while counter-clockwise rotation of the extension rod 30 will push the extension rod 30 out of the bore and allow complete disengagement.

It may be desirable for the extension rod 30 to be threaded at both ends, as depicted in FIG. 1. This allows several extension rod sections to be sequentially fastened together so that the paint brush 10 can be held at various lengths from the body and easily manipulated during painting.

Preferably, the extension 30 is about two feet in length. This allows easy manipulation of the brush 10 by a person of average height standing on the floor to paint the ceiling molding and ceiling-wall junction of an eight foot high wall. Where the wall-ceiling intersection is higher, such as in rooms with elevated ceilings and at entry-ways and stair wells, it is desirable to employ the six and eight foot poles conventionally used to manipulate paint rollers.

In use to paint wall-ceiling intersections, the paint brush 10 is grasped by the extension rod 30 and held approximately in the position depicted in FIG. 1, wherein the elongated dimension of the stock 16 is generally vertical and with the handle 12 extending substantially horizontally outward from the wall. In this position, the extension rod 30 angles upward at approximately 45°. The brush 10 is then moved in horizontal strokes to paint ceiling trim and wall-ceiling junctions. If necessary to secure greater coverage, the extension rod 30 can be twisted slightly to offset the alignment of the long dimension of the stock 16 from the vertical. This forces more bristles into crevices in the moldings or into the wall-ceiling intersections.

The orientation of the extension rod 30 and brush 10 is reversed from that of FIG. 1 to paint baseboards. That is, the extension rod 30 is angled downward at an angle of about 45° and the handle 12 of the brush 10 again extends substantially horizontally outward while the long dimension of the stock 16 is again oriented in a generally vertical position. To paint baseboards in this fashion, the brush is moved in lateral strokes similar to those employed in painting ceiling molding.

It is apparent that the single embodiment of the invention depicted is illustrative only, and specific design features of the paint brush 10 and extension rod 30 are not essential to the invention, except as set forth in the appended claims. For example, instead of employing a locking pin 28, the interior section 32 of the adapter 24 may be threadably engaged in a tapped bore in the stock 16 in a reverse thread orientation relative to the threads on the extension rod 30. That is, the extension rod 30 may be equipped with conventional right hand threads, while the exterior of the section 32 of the adapter 24 would not come free upon counter rotation of the extension rod 30. Alternatively, the pin 28 need not be employed where a sufficient frictional engagement exists between the adapter 24 and the stock 16.

One other significant feature of the invention is that it can be used as a conventional paint brush when desired. The brush extension 30 can be threadably disengaged from the adapter and the brush 10 can then be used to paint window trim and other finish details by hand. This avoids the necessity of using an extra brush, and thus reduce the amount of painting equipment required for a particular job.

It should be understood that numerous variations and modifications of the invention will undoubtedly become apparent to those skilled in the art so that the invention is not limited to the specific embodiment depicted, but rather is defined in the claims appended hereto.

We claim:

1. A paint brush adapted for remote manipulation comprising an axial handle integral with and terminating in an oblong stock, bristles attached to said stock and extending in a direction opposite to said handle, and an adaptor for receiving an extension rod mounted in said stock and laterally surrounded by the structure of said stock and located proximate to said handle and at an angle relative thereto, and in co-planar arrangement with said handle and said stock, wherein said adapter is a plug of cylindrical cross-section internally tapped at a diameter at about 11/16 inches and with a thread pitch at about 3/16 inches and force fitted into a well drilled into said stock and having a section at its outermost extremity external to said stock radially reinforced by a circular band positioned thereabout.

2. A paint brush according to claim 1, further characterized in that said adapter is mounted at an angle of between about 30° and 60° relative to said axial handle.

3. A paint brush according to claim 2, further characterized in that said adapter is mounted at an angle of about 45° relative to said axial handle.

4. In a paint brush having an oblong stock with an integrally formed axial handle extending therefrom and bristles attached thereto extending opposite said handle from said stock, the improvement wherein a well is defined within the structure of said stock proximate to said handle and at an angle thereto and coplanar with said handle, an adapter for receiving an extension rod, said adapter having a central tapped bore at a diameter of about 11/16 inches and with a thread pitch of about 3/16 inches with a section extending into said stock in said well, and a protruding section about which a circular band is positioned for radial reinforcement.

5. The paint brush according to claim 4, further characterized in that said adapter is frictionally immobilized in said well, and further comprising locking means for preventing withdrawal of said adapter from said well.

6. The paint brush according to claim 4 further characterized in that said section extending into said well is an interior section of reduced diameter and said protruding section is a section external of said stock of expanded diameter.

7. The paint brush according to claim 6, further characterized in that an extension rod threaded at both ends is received by said bore.

* * * * *